US009754703B2

(12) United States Patent
Inoue et al.

(10) Patent No.: US 9,754,703 B2
(45) Date of Patent: Sep. 5, 2017

(54) COPPER ALLOY WIRE ROD AND METHOD FOR MANUFACTURING THE SAME

(71) Applicants: NGK Insulators, Ltd., Nagoya-Shi (JP); Tohoku University, Sendai-Shi (JP)

(72) Inventors: Akihisa Inoue, Sendai (JP); Hisamichi Kimura, Sendai (JP); Naokuni Muramatsu, Nagoya (JP)

(73) Assignees: NGK Insulators, Ltd., Nagoya (JP); Tohoku University, Sendai-Shi (JP)

( * ) Notice: Subject to any disclaimer, the term of this patent is extended or adjusted under 35 U.S.C. 154(b) by 476 days.

(21) Appl. No.: 14/219,348

(22) Filed: Mar. 19, 2014

(65) Prior Publication Data

US 2014/0205492 A1 Jul. 24, 2014

Related U.S. Application Data

(63) Continuation of application No. PCT/JP2012/073874, filed on Sep. 19, 2012.

(30) Foreign Application Priority Data

Sep. 29, 2011 (JP) ..... 2011-214983

(51) Int. Cl.
*C22F 1/08* (2006.01)
*H01B 13/00* (2006.01)
(Continued)

(52) U.S. Cl.
CPC ..... *H01B 13/0006* (2013.01); *B21C 1/003* (2013.01); *B22D 7/005* (2013.01);
(Continued)

(58) Field of Classification Search
CPC ..... C22C 9/00; C22F 1/08
See application file for complete search history.

(56) References Cited

U.S. PATENT DOCUMENTS

2005/0211346 A1 9/2005 Kimura et al.
2006/0086437 A1 4/2006 Nippert et al.
(Continued)

FOREIGN PATENT DOCUMENTS

CN 1804072 A 7/2006
CN 102041407 A * 5/2011 ..... C22C 9/00
(Continued)

OTHER PUBLICATIONS

Masataka Sugiyama, et al., "*Properties of High Zirconium Wrought Copper Base Alloys*," J. Japan Inst. Metals, vol. 30, No. 1 (1966), pp. 32-37.
(Continued)

*Primary Examiner* — Roy King
*Assistant Examiner* — Jophy S Koshy
(74) *Attorney, Agent, or Firm* — Burr & Brown, PLLC

(57) ABSTRACT

A copper alloy wire rod includes a copper parent phase and short fiber-shaped composite phases which are dispersed in the copper parent phase and which contain $Cu_8Zr_3$ and Cu, wherein the content of Zr is within the range of 0.2 atomic percent or more and 1.0 atomic percent or less. This copper alloy wire rod can be obtained by including the steps of melting a raw material in such a way that a copper alloy having a Zr content within the above-described range of is produced so as to obtain a molten metal in a melting step, casting the molten metal so as to obtain an ingot in a casting step, and subjecting the ingot to cold wire drawing in a wire drawing step, wherein the wire drawing step and a treatment after the wire drawing step are performed at lower than 500° C.

6 Claims, 13 Drawing Sheets

(a)

(b)

(51) Int. Cl.

| | |
|---|---|
| ***B22D 7/00*** | (2006.01) |
| ***C22C 9/00*** | (2006.01) |
| ***H01B 1/02*** | (2006.01) |
| ***B21C 1/00*** | (2006.01) |

(52) U.S. Cl.

CPC ..... *C22C 9/00* (2013.01); *C22F 1/08* (2013.01); *H01B 1/026* (2013.01)

(56) References Cited

U.S. PATENT DOCUMENTS

| | | | |
|---|---|---|---|
| 2010/0147483 | A1 | 6/2010 | Kimura et al. |
| 2012/0018192 | A1 | 1/2012 | Takahashi et al. |
| 2012/0148441 | A1 | 6/2012 | Muramatsu et al. |

FOREIGN PATENT DOCUMENTS

| | | | |
|---|---|---|---|
| JP | 03-072042 | A1 | 3/1991 |
| JP | 04-176849 | A1 | 6/1992 |
| JP | 11-256295 | A1 | 9/1999 |
| JP | 11-293431 | A1 | 10/1999 |
| JP | 2000-160311 | A1 | 6/2000 |
| JP | 2005-281757 | A1 | 10/2005 |
| JP | 2007-302994 | A1 | 11/2007 |
| JP | 2010-222624 | | 10/2010 |
| JP | 2011-058029 | A1 | 3/2011 |
| KR | 10-2006-0044922 | A | 5/2006 |
| WO | 2010/084989 | A1 | 7/2010 |
| WO | 2011/030898 | A1 | 3/2011 |

OTHER PUBLICATIONS

International Search Report and Written Opinion dated Dec. 11, 2012.

Korean Office Action (Application No. 10-2014-7006588) dated Aug. 31, 2015.

Hisamichi Kimura, et al., "*Ultrahigh Strength and High Electrical Conductivity Characteristics of Cu—Zr Alloy Wires with Nanoscale Duplex Fibrous Structure*," Materials Transactions, 2006, vol. 47, No. 6, pp. 1595-1598.

Hisamichi Kimura, et al., "*Mechanical Properties and Electrical Conductivity of Heavily Cold-Rolled* $Cu_{100-x}Zr_x$ *Alloys* (x=0-8)," Materials Transactions, 2005, vol. 46, No. 7, pp. 1733-1736.

Chinese Office Action (Application No. 201280047957.0) dated Mar. 30, 2015.

* cited by examiner

| Point | O_K | Cu_K | Zr_L |
|---|---|---|---|
| 1 | 2.6 | 91.0 | 6.4 |
| 2 | 4.7 | 89.8 | 5.5 |
| 3 | – | 100.0 | – |

(Atomic%)

| Compound | Pearson Symbol | a[Å] | b[Å] | c[Å] | α[°] | β[°] | γ[°] |
|---|---|---|---|---|---|---|---|
| $Cu_5Zr$ | cF-43m | 6.870 | – | – | 90 | – | 90 |
| $Cu_8Zr_3$ | oP44 | 7.869 | 8.155 | 9.985 | 90 | 90 | 90 |
| $Cu_9Zr_2$ | tP24 | 6.856 | – | 6.882 | 90 | – | – |

| Compound | Pearson Symbol | Lattice plane | Lattice spacing d[Å] |
|---|---|---|---|
| $Cu_5Zr$ | cF-43m | 111 | 3.966 |
| | | 210 | 3.072 |
| | | 320 | 1.905 |
| $Cu_8Zr_3$ | oP44 | 200 | 3.935 |
| | | 022 | 3.158 |
| | | 401 | 1.930 |
| $Cu_9Zr_2$ | tP24 | 111 | 3.963 |
| | | 102 | 3.075 |
| | | 203 | 1.906 |

(a) Visual field 1／BF image (b)) Visual field 1／HAADF image (c) Visual field 2／BF image (d)) Visual field 2／HAADF image

| Point | O_K | Cu_K | Zr_L |
|---|---|---|---|
| 1 | 3.16 | 75.77 | 21.07 |
| 2 | – | 100.0 | – |
| 3 | – | 100.0 | – |

(Atomic%)

| Compound | Pearson Symbol | a[Å] | b[Å] | c[Å] | α[°] | β[°] | γ[°] |
|---|---|---|---|---|---|---|---|
| $Cu_5Zr$ | cF-43m | 6.870 | - | - | 90 | - | 90 |
| $Cu_8Zr_3$ | oP44 | 7.869 | 8.155 | 9.985 | 90 | 90 | 90 |
| $Cu_9Zr_2$ | tP24 | 6.856 | - | 6.882 | 90 | - | - |

| Compound | Pearson Symbol | Lattice plane | Lattice spacing d[Å] |
|---|---|---|---|
| $Cu_5Zr$ | cF-43m | 111 | 3.966 |
| | | 200 | 3.435 |
| | | 220 | 2.429 |
| $Cu_8Zr_3$ | oP44 | 021 | 3.775 |
| | | 121 | 3.403 |
| | | 213 | 2.426 |
| $Cu_9Zr_2$ | tP24 | 111 | 3.963 |
| | | 200 | 3.428 |
| | | 202 | 2.429 |

| Point | O_K | Cu_K | Zr_L |
|---|---|---|---|
| 1 | – | 85.4 | 14.6 |
| 2 | – | 100.0 | – |
| 3 | – | 79.1 | 20.9 |

(Atomic%)

| Compound | Pearson Symbol | a[Å] | b[Å] | c[Å] | α[° ] | β[° ] | γ[° ] |
|---|---|---|---|---|---|---|---|
| $Cu_5Zr$ | cF-43m | 6.870 | - | - | 90 | - | 90 |
| $Cu_8Zr_3$ | oP44 | 7.869 | 8.155 | 9.985 | 90 | 90 | 90 |
| $Cu_9Zr_2$ | tP24 | 6.856 | - | 6.882 | 90 | - | - |

| Compound | Pearson Symbol | Lattice plane | Lattice spacing d[Å] |
|---|---|---|---|
| $Cu_5Zr$ | cF-43m | 111 | 3.966 |
| | | 221 | 2.290 |
| | | 332 | 1.465 |
| $Cu_8Zr_3$ | oP44 | 021 | 3.775 |
| | | 312 | 2.233 |
| | | 512 | 1.476 |
| $Cu_9Zr_2$ | tP24 | 111 | 3.963 |
| | | 300 | 2.285 |
| | | 323 | 1.464 |

COPPER ALLOY WIRE ROD AND METHOD FOR MANUFACTURING THE SAME

BACKGROUND OF THE INVENTION

1. Field of the Invention

The present invention relates to a copper alloy wire rod and a method for manufacturing the same.

2. Description of the Related Art

Heretofore, Cu—Zr based copper alloys have been known as copper alloy wire rods. For example, PTLs 1 and 2 propose copper alloys for wire rods, wherein the electrical conductivity and the tensile strength are improved by subjecting a copper alloy containing 0.01 to 0.50 percent by mass of Zr to wire drawing to a final wire diameter while a solution treatment is performed and, thereafter, performing a predetermined aging treatment. The strength of these copper alloy wire rods is enhanced by precipitating $Cu_3Zr$ into a Cu parent phase. Also, PTLs 3 and 4 propose copper alloys, wherein the strength and the electrical conductivity are improved by subjecting a copper alloy containing 0.005 to 0.5 percent by mass of Zr and 0.001 to 0.3 percent by mass of Co to a solution treatment while hot rolling is performed, followed by cold rolling, and subjecting the parent material after the cold rolling to a heat treatment. Meanwhile, NPL 1 proposes that a copper alloy containing 0.33 to 2.97 percent by mass of Zr is melt-refined, and precipitation hardening and $Cu_3Zr$ dispersion hardening are realized at the same time by combination of hot rolling, a solution treatment, and an aging treatment so as to enhance strength without impairing the electrical conductivity to a large extent.

CITATION LIST

Patent Literature

PTL 1: Japanese Unexamined Patent Application Publication No. 11-256295

PTL 2: Japanese Unexamined Patent Application Publication No. 2000-160311

PTL 3: Japanese Unexamined Patent Application Publication No. 2010-222624

PTL 4: Japanese Unexamined Patent Application Publication No. 2011-58029

Non Patent Literature

NPL 1: J. Japan Inst. Met. Mater., Vol. 30, p. 32-37, (1966)

SUMMARY OF THE INVENTION

Technical Problem

However, those disclosed in PTLs 1 to 4 and NPL 1 did not ensure the compatibility between a high electrical conductivity of 70% IACS or more and high tensile strength of 700 MPa or more. Therefore, those which can enhance both the electrical conductivity and the tensile strength have been desired.

The present invention has been made to solve the above-described problems and it is a main object to provide a copper alloy wire rod which can ensure the compatibility between an electrical conductivity of 70% IACS or more and tensile strength of 700 MPa or more.

Solution to Problem

In order to achieve the above-described object, the present inventors performed intensive research. As a result, it was found that both the electrical conductivity and the tensile strength were able to be enhanced by including a copper parent phase and fiber-shaped composite phases which were dispersed in the copper parent phase and which contained $Cu_8Zr_3$ and Cu, wherein the content of Zr was specified to be within the range of 0.2 atomic percent or more and 1.0 atomic percent or less.

That is, the copper alloy wire rod of the present invention includes a copper parent phase and short fiber-shaped composite phases which are dispersed in the copper parent phase and which contain $Cu_8Zr_3$ and Cu, wherein the content of Zr is within the range of 0.2 atomic percent or more and 1.0 atomic percent or less.

This copper alloy wire rod can ensure the compatibility between an electrical conductivity of 70% IACS or more and tensile strength of 700 MPa or more. Although the reason for such effects is not certain, but is estimated that the composite phase containing $Cu_8Zr_3$ and Cu is present in an appropriate state in the copper parent phase.

Meanwhile, a method for manufacturing a copper alloy wire rod, according to the present invention, includes a melting step of melting a raw material in such a way that a copper alloy having a Zr content within the range of 0.2 atomic percent or more and 1.0 atomic percent or less is produced so as to obtain a molten metal, a casting step of casting the above-described molten metal so as to obtain an ingot, and a wire drawing step of subjecting the above-described ingot to cold wire drawing, wherein the above-described wire drawing step and a treatment after the wire drawing step are performed at lower than 500° C.

According to this manufacturing method, the above-described copper alloy wire rod of the present invention can be produced relatively easily.

DETAILED DESCRIPTION OF THE INVENTION

Figure 1:
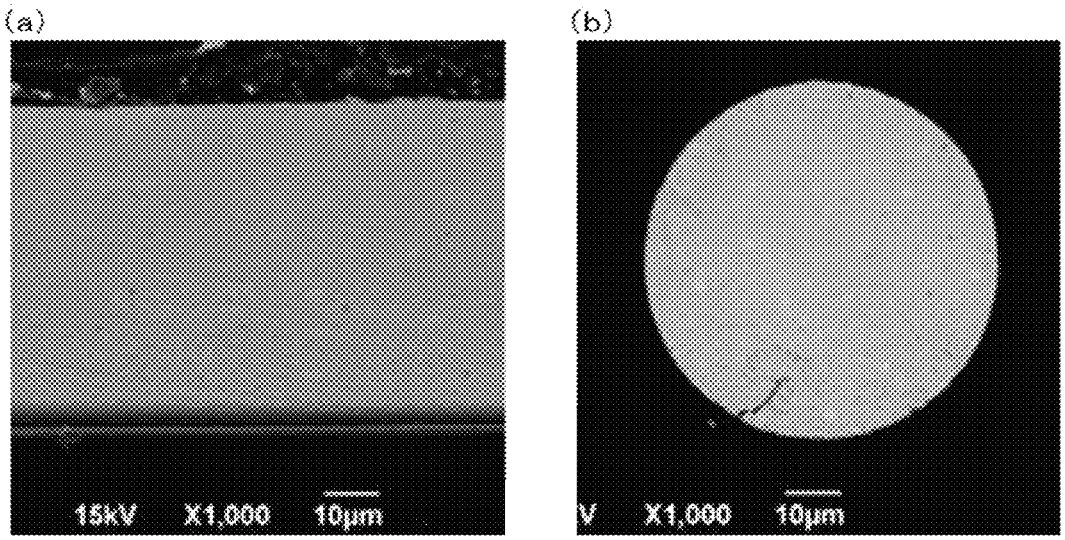
FIG. 1 shows SEM photographs of a vertical cross-section (a) and a horizontal cross-section (b) of Example 12.

A copper alloy wire rod according to the present invention includes a copper parent phase and short fiber-shaped composite phases which are dispersed in the copper parent phase. When a reflection electron image of this copper alloy wire rod is observed with a scanning electron microscope (SEM), the copper parent phase looks black as compared with the composite phase and the composite phase looks white as compared with the copper parent phase.

It is considered that the copper parent phase is derived from proeutectic copper. Although it is estimated that the proeutectic copper contains a small amount of solid solution with Zr, for the most part, components other than copper are hardly contained. Therefore, it is considered that the electrical conductivity of the copper parent phase is a value close to 100% IACS. Here, the electrical conductivity refers to an electrical conductivity expressed by a ratio relative to the electrical conductivity of tempered pure copper, which is assumed to be 100%, and % IACS is used as the unit (the same goes hereafter).

The composite phase is configured to contain $Cu_8Zr_3$ and Cu. It is considered that this composite phase is mainly derived from an eutectic phase crystallized in the proeutectic copper and is generated on the basis of deformation, phase transformation, or the like of this eutectic phase by wire drawing. The composite phases have the shapes of short fibers and can enhance the tensile strength by being dispersed in the copper parent phase as compared with that in the case where the composite phase is not present. Here, the term "shape of a short fiber" can refer to that, for example, when a vertical cross-section of the wire rod is observed, $1.5 \leq L/T < 17.9$ is satisfied, where the length of the composite phase in the wire drawing direction is specified to be L and the length (thickness) in the direction orthogonal to the wire drawing direction is specified to be T. It is considered that in the case where L/T is 1.5 or more, $Cu_8Zr_3$ has been formed by cold severe plastic deformation. Meanwhile, in the case where L/T is less than 17.9, the copper parent phase and the composite phases are not layered and the composite phases can be dispersed into the copper parent phase. In this range, the composite phases satisfy preferably $1.5 \leq L/T \leq 10.0$. Also, when the cross-section of the wire rod is observed, the area ratio of the composite phases is preferably 0.5% or more and 5.0% or less in the whole cross-section of the wire rod. An effect of enhancing the tensile strength is obtained when the area ratio is 0.5% or more, and reduction in the electrical conductivity can be suppressed when the area ratio is 5% or less. It is enough that the composite phases are dispersed in the copper parent phase. However, finer dispersion is preferable because it is considered that the tensile strength can be further enhanced and reduction in the electrical conductivity can be suppressed. In this regard, in determination of the above-described L/T and ratio of the composite phase, it is preferable that determination be performed on the basis of observation with SEM at a magnification of about 1,000 times. In the case where the contrast of a SEM photograph is not clear, observation may be performed on the basis of binarization or the like. In the binarization, a threshold value usually used by a person skilled in the art can be used.

Whether the composite phase contains $Cu_8Zr_3$ or not can be determined on the basis of the NBD (nano-beam diffraction) analysis results. For example, in the case where a lattice constant determined from each of typical three diffraction patterns (here, referred to as $d_1$, $d_2$, and $d_3$) other than the diffraction pattern of Cu among the diffraction patterns observed by NBD agrees with a lattice spacing of any one of lattice plane of $Cu_8Zr_3$, it can be said that $Cu_8Zr_3$ is present. Here, the fact that a lattice constant agrees with a lattice spacing of $Cu_8Zr_3$ refers to that the difference between the two is within ±0.05 Å. For reference, each of the lattice spacings of $Cu_8Zr_3$ is explained as an example. The (021) plane lattice spacing of $Cu_8Zr_3$ is 3.775 Å, the (121) plane lattice spacing is 3.403 Å, the (213) plane lattice spacing is 2.426 Å, the (200) plane lattice spacing is 3.935 Å, the (022) plane lattice spacing is 3.158 Å, the (401) plane lattice spacing is 1.930 Å, the (312) plane lattice spacing is 2.233 Å, and the (512) plane lattice spacing is 1.476 Å. In this regard, as for the sample used for the NBD analysis, a wire rod made thin by using an Ar ion-milling method can be used. Meanwhile, this composite phase may contain, for example, $Cu_5Zr$ and $Cu_9Zr_2$. However, it is preferable that the amount of those other than $Cu_8Zr_3$ and Cu be reduced and it is more preferable that the composite phase be composed of $Cu_8Zr_3$ and Cu.

The copper alloy wire rod according to the present invention has a Zr content within the range of 0.2 atomic percent or more and 1.0 atomic percent or less. The remainder may contain elements other than Cu. However, it is preferable that the remainder be composed of Cu and incidental impurities and it is preferable that the incidental impurities be minimized. That is, Cu—Zr binary alloys represented by a composition formula of $Cu_{100-x}Zr_x$, where x in the formula is 0.2 or more and 1.0 or less, is preferable. The proportion of Zr is preferably 0.2 atomic percent or more and 1.0 atomic percent or less, and more preferably 0.36 atomic percent or more and 1.0 atomic percent or less. In the case where Zr is 0.20 atomic percent or more, the strength can be enhanced by crystallization of the composite phases, and in the case of 1.00 atomic percent or less, the composite phases having a low electrical conductivity do not increase excessively and the electrical conductivity is not reduced easily. In particular, the binary alloy composition represented by the composition formula of $Cu_{100-x}Zr_x$ is preferable because an appropriate amount of composite phases can be obtained more easily. Also, the binary alloy composition is preferable because reuse of raw material scraps, other than products, derived on the way of production and component scraps to be subjected to a scrapping treatment because of expiration of the period of durability as raw materials for remelting can be controlled easily.

The copper alloy wire rod according to the present invention can ensure the compatibility between an electrical conductivity of 70% IACS or more and tensile strength of 700 MPa or more. Furthermore, the compatibility between an electrical conductivity of 80% IACS or more and tensile strength of 800 MPa or more can be ensured depending on the composition and the structure control. For example, the tensile strength can be enhanced by increasing the proportion (atomic percent) of Zr or increasing the degree of wire drawing $\eta$. Meanwhile, the electrical conductivity of the composite phase is lower than that of the copper parent phase and, therefore, the electrical conductivity can be increased by reducing the area ratio of such composite phases. Also, the electrical conductivity can be increased by reducing the value of L/T in such a way that these composite phases do not form layers with the copper parent phase but are dispersed into the copper parent phase.

Next, a method for manufacturing a copper alloy wire rod, according to the present invention, will be described. The method for manufacturing a copper alloy wire rod, according to the present invention, may include (1) a melting step to melt a raw material so as to obtain a molten metal, (2) a casting step to cast the molten metal so as to obtain an ingot, and (3) a wire drawing step to subject the ingot to cold wire drawing. Each of these steps will be described below sequentially.

(1) Melting Step

In this melting step, a treatment to obtain a molten metal by melting a raw material is performed. As for the raw material, an alloy may be used or a pure metal may be used insofar as a copper alloy having a Zr content within the range of 0.2 atomic percent or more and 1.0 atomic percent or less can be produced. Preferably, this raw material does not contain those other than Cu and Zr, because reduction in the electrical conductivity can be further suppressed. The melting method is not specifically limited. Common high-frequency induction melting method, low-frequency induction melting method, arc melting method, electron beam melting method, and the like may be employed, and a levitation melting method and the like may be employed. Among them, the high-frequency induction melting method or the levitation melting method is used preferably. In the high-frequency induction melting method, a large amount can be melted at a time. In the levitation melting method, a metal to be melted is levitated and melted, so that contamination of impurities from a crucible or the like can be further suppressed. The melting atmosphere is preferably a vacuum atmosphere or an inert atmosphere. It is enough that the inert atmosphere is a gas atmosphere which has no influence on an alloy composition and, for example, a nitrogen atmosphere, a helium atmosphere, an argon atmosphere, and the like may be employed. Among them, the argon atmosphere is used preferably.

(2) Casting Step

In this step, a treatment to obtain an ingot is performed by pouring the molten metal into a mold so as to perform casting. The casting method is not specifically limited. For example, a metal mold casting method and a low-pressure casting method may be employed, or die casting methods, e.g., a common die casting method, a squeeze casting method, and a vacuum die casting method, may be employed. Also, a continuous casting method may be employed. The mold used for casting can be made from pure copper, a copper alloy, an alloy steel, or the like. Among them, as for the pure copper mold, the cooling rate can be increased and, therefore, the degree of dispersion of the composite phases can be increased. The structure of the mold is not specifically limited, and a mold capable of adjusting a cooling rate by disposing a water cooling pipe in the inside of the mold may be employed. The shape of the resulting ingot is not specifically limited, although a long slender bar shape is preferable because the cooling rate can be further increased. Among them, a round bar shape is preferable because more uniform cast structure can be obtained.

(3) Wire Drawing Step

In this step, a treatment to obtain a copper alloy wire rod is performed by subjecting the ingot to wire drawing. Here, the term "cold" refers to that heating is not performed and indicates that wire drawing is performed at ambient temperature. In the case where cold wire drawing is performed, as described above, recrystallization or recovery of the structure can be suppressed and the aspect ratio of the composite phase can be increased. The wire drawing method is not specifically limited, and examples include drawing, e.g., hole die drawing and roller die drawing, extrusion, swaging, and grooved roll working. It is preferable that the wire drawing method be a method in which shear slip deformation occurs in a workpiece by application of a shear force in the direction parallel to an axis (for example, drawing). In the present specification, such wire drawing may be referred to as shearing wire drawing because it is considered that, in the shearing wire drawing, $Cu_8Zr_3$ is obtained reliably by large strain along with the shear slip deformation. The shear slip deformation can be provided by, for example, causing simple shear deformation, where a material is drawn through a die while being applied with friction from the contact surface of the die. In the case where the die is used, drawing may be performed up to a final wire diameter by using a plurality of dies having different sizes. According to this, breaking of a wire does not occur easily during wire drawing. The hole of a wire drawing die is not limited to be circular, and an angular wire die, an odd-form die, a tube die, and the like may be used. Also, a heat treatment at a temperature higher than the temperature in the wire drawing and 500° C. or lower for 1 second or more and 60 seconds or less may be performed between wire drawing and wire drawing. In the case where heating is performed for 1 second or more, a strain relief effect can be expected and wire drawing becomes easy. Meanwhile, heating for 60 seconds or less does not cause recrystallization and recovery easily. In this regard, in the case where such heating is performed, preferably, finishing wire drawing to reach the final wire diameter is performed by die wire drawing, in which shear deformation with a large strain is applied, after the heat treatment.

In the wire drawing step, wire drawing is performed preferably in such a way that the degree of wire drawing $\eta$ becomes 5.0 or more and 12.0 or less. It is considered that, according to this, $Cu_8Zr_3$ can be obtained more reliably. In addition, it is considered that the composite phases have the shapes of short fibers easily and are dispersed in the copper parent phase easily. Here, the degree of wire drawing $\eta$ is a value determined from the cross-sectional area $A_0$ ($mm^2$) before the wire drawing and the cross-sectional area A ($mm^2$) after the wire drawing on the basis of the formula of $\eta=\ln(A_0/A)$.

In the manufacturing method according to the present invention, the wire drawing and a treatment after the wire drawing are performed at lower than 500° C. in order that recrystallization and recovery are suppressed and the composite phases are suppressed from not having the shapes of short fibers.

The above-described copper alloy wire rod according to the present invention can be obtained by this manufacturing method.

In this regard, it is needless to say that the present invention is not limited to the above-described embodiment and can be executed in various aspects within the technical scope of the present invention.

In the above-described embodiment, the method for manufacturing a copper alloy wire rod is specified to include the melting step, the casting step, and the wire drawing step, although other steps may be included. For example, a holding step which is a step to hold the molten metal may be included between the melting step and the casting step. In the case where the holding step is included, an operation efficiency can be increased because when the treatment capacity of the melting step and that of the casting step are different, adjustment can be performed by the holding step. In this regard, fine adjustment can be performed more easily by performing component adjustment in the holding step. Meanwhile, a cooling step to cool the ingot may be included between the casting step and the wire drawing step. According to this, the time period from casting to wire drawing can be reduced. Also, a facing step to grind a casting surface of the ingot may be included between the casting step and the wire drawing step. According to this, breaking of a wire during wire drawing and defective forming derived from unevenness of the casting surface can be suppressed. Also, a homogenizing step to perform heating under the condition (temperature range and time) for not causing recrystallization may be included between the casting step and the wire drawing step. In the homogenization, for example, heating may be performed at a temperature of 550° C. or higher and 800° C. or lower for 1 minute or more and 60 minutes or less. It is considered that, in the case where the homogenization is performed, breaking of a wire during wire drawing can be suppressed and the tensile strength of the resulting wire rod can be enhanced because the degree of dispersion of the composite phases can be increased. Meanwhile, after the wire drawing step, a rolling step to perform flat wire rolling which causes plane strain deformation in a wire rod may be included. According to this, for example, a copper alloy wire rod having a circular cross-section is allowed to have a flat cross-section (hereafter may be referred to as a rectangular wire) easily. In the case where the rectangular wire is used for winding, the winding density can be increased as compared with that of the wire rod having a circular cross-section. Preferably, the flat wire rolling is performed under the condition for allowing the aspect ratio represented by l/2t to become 5.0 or more and 30 or less, where the width (length of long side of horizontal cross-section) is specified to be l and the thickness (length of short side of horizontal cross-section) is specified to be 2t. This is because when the aspect ratio is specified to be 5.0 or more, the shape of the horizontal cross-section becomes substantially rectangular, the squareness represented by R/t increases, where the curvature radii of four corners of the horizontal cross-section are specified to be R and the length of short side of the horizontal cross-section is specified to be 2t, and a large curvature does not remain at four corners easily. Also, this is because when the aspect ratio is specified to be 30 or less, roughening of side surfaces of the rectangular wire due to deformation cracking or the like can be prevented. Also, this is because when the aspect ratio is specified to be 30 or less, accurate rolling can be performed by even one rolling pass without repeating the rolling pass a plurality of times. Meanwhile, in the flat wire rolling, preferably, rolling is performed in such a way that the dimensional accuracy of width l becomes ±2% or less on a 1,000 mm of length of rectangular wire basis. According to this, the straightness of the rectangular wire is high and normal winding, in which a wire is neatly wound in the winding, is performed easily. Also, in the flat wire rolling, preferably, the thickness 2t of the horizontal cross-section is specified to be 0.010 mm or more and 0.200 mm or less. In a common rolling method, 0.010 mm is a thickness close to the rolling limit. According to the rolling in which the thickness of a rectangular wire is specified to be 0.200 mm or less, a rectangular wire having a stable thickness can be obtained relatively easily, and the squareness can be increased. Preferably, this flat wire rolling includes only one cold rolling pass because if the flat wire rolling is performed a plurality of times, the straightness is lost easily in the winding of the rectangular wire after rolling and it is difficult to ensure the straightness even when the winding pressure and the like are controlled. Also, only one rolling pass is preferable from the viewpoint of difficulty of change in characteristics, e.g., the tensile strength and the electrical conductivity of a wire rod before rolling, ease of controlling the dimension, and an improvement in the productivity due to simple steps. The flat wire rolling can be performed by using, for example, a two-high rolling mill provided with a pair of rolling rolls, while tension is applied before and after the rolling mill, as with rolling of a common flat plate.

In the above-described embodiment, the method for manufacturing a copper alloy wire rod, the melting step, the casting step, and the wire drawing step are described as separate steps, although the steps may be continuous, where boundaries therebetween are not clear, as with continuous casting and wire drawing, which is used as an integrated manufacturing method of a copper wire or the like. In this manner, a copper alloy wire rod can be obtained more efficiently.

EXAMPLES

Specific examples, in which the copper alloy wire rods according to the present invention were produced, will be described below.

[Production of Wire Rod]

Example 1

Initially, raw materials weighed in such a way as to become a Cu—Zr binary alloy composed of 0.20 atomic percent of Zr and the remainder of Cu were put into a quartz tube, and high-frequency induction melting was performed in a chamber replaced with an Ar gas. A molten metal obtained by sufficient melting was poured into a pure copper mold so as to cast a round bar ingot having a diameter of 12 mm and a length of about 180 mm. Thereafter, the round bar ingot cooled to room temperature was subjected to facing until the diameter became 11 mm so as to remove unevenness of the casting surface. Subsequently, a wire rod of Example 1 was obtained by performing wire drawing at ambient temperature in such a way that the diameter of the wire rod after the wire drawing (wire drawing diameter) became 0.040 mm by passing through 20 to 40 dies having hole diameters which were specified to become smaller sequentially. In this regard, the dies used for the wire drawing were provided with a die hole in the center, and shearing wire drawing was performed by passing through a plurality of dies having different hole diameters sequentially.

Examples 2 to 14

Wire rods of Examples 2 to 14 were obtained through the same steps as those in Example 1 except that cast workpieces having raw material compositions shown in Table 1 were used and wire drawing was performed until wire drawing diameters shown in Table 1 were reached.

Comparative Examples 1 to 4

Wire rods of Comparative examples 1 to 4 were obtained through the same steps as those in Example 1 except that cast workpieces having raw material compositions shown in Table 1 were used and wire drawing was performed until wire drawing diameters shown in Table 1 were reached.

Examples 15 to 17

Wire rods of Examples 15 to 17 were obtained by using the wire rod of Comparative example 5 and further performing flat wire rolling with one rolling pass at room temperature in such a way that dimensions shown in Table 2 were obtained.

Examples 18 to 21

The wire rods of Example 13 were held at 100° C., 200° C., 300° C., and 400° C. for 1 hour and were taken as Examples 18, 19, 20, and 21, respectively.

Comparative Examples 5 to 8

The wire rods of Example 13 were held at 500° C., 550° C., 600° C., and 650° C. for 1 hour and were taken as Comparative examples 5, 6, 7, and 8, respectively.

[Derivation of Degree of Wire Drawing]

The degree of wire drawing (η) was determined from the cross-sectional area $A_0$ ($mm^2$) before the wire drawing and the cross-sectional area A ($mm^2$) after the wire drawing on the basis of the formula of $\eta=\ln(A_0/A)$.

[Derivation of Area Ratio of Composite Phases]

The area ratio of the composite phases was derived as described below. Initially, a horizontal cross-section of the wire rod was observed with SEM at a magnification of 1,000 times or more. Subsequently, the proportion of composite phases which looked white as compared with the parent phase, was determined on the basis of image analysis in a visual field including the whole cross-section or a visual field of 50 μm×50 μm including the center of the cross-section.

[Derivation of Aspect Ratio L/T of Composite Phase]

The aspect ratio L/T of composite phase was derived as described below. Initially, a vertical cross-section of the wire rod was observed with SEM at a magnification of 1,000 times or more and in a visual field of at least 50 μm×100 μm, composite phases, which looked flat and white, at 30 places were randomly selected. Subsequently, the length L in the wire drawing direction and the length (thickness) T in the direction orthogonal to the wire drawing direction of each composite phase were measured, L/T was calculated, and the average value thereof was specified to be the aspect ratio L/T.

[Identification of $Cu_8Zr_3$]

Identification of $Cu_8Zr_3$ was performed as described below. Initially, a sample of each wire rod made fine by using an Ar ion-milling method was prepared. This sample was subjected to structure observation by using a scanning transmission electron microscope (STEM). Subsequently, in the view field subjected to the structure observation, composition analysis was performed by using an energy dispersive X-ray analyzer (EDX) so as to distinguish Cu from a Cu—Zr compound. Then, the Cu—Zr compound was subjected to structure analysis on the basis of nano-beam diffraction (NBD).

[Measurement of Tensile Strength]

The tensile strength was measured by using a universal tester (Autograph AG-1kN produced by SHIMADZU CORPORATION) in conformity with JISZ2201. Then, the tensile strength which was the value obtained by dividing the maximum load by the initial cross-sectional area of the copper alloy wire rod was determined.

[Measurement of Electrical Conductivity]

As for the electrical conductivity, the volume resistance ρ of the wire rod was measured in conformity with JISH0505, and the ratio relative to the resistance value of tempered pure copper (1.7241 μΩcm) was calculated and converted to the electrical conductivity (% IACS). The following formula was used for conversion. electrical conductivity γ (% IACS)=1.7241+volume resistance ρ×100.

[Experimental Results]

Figure 2:
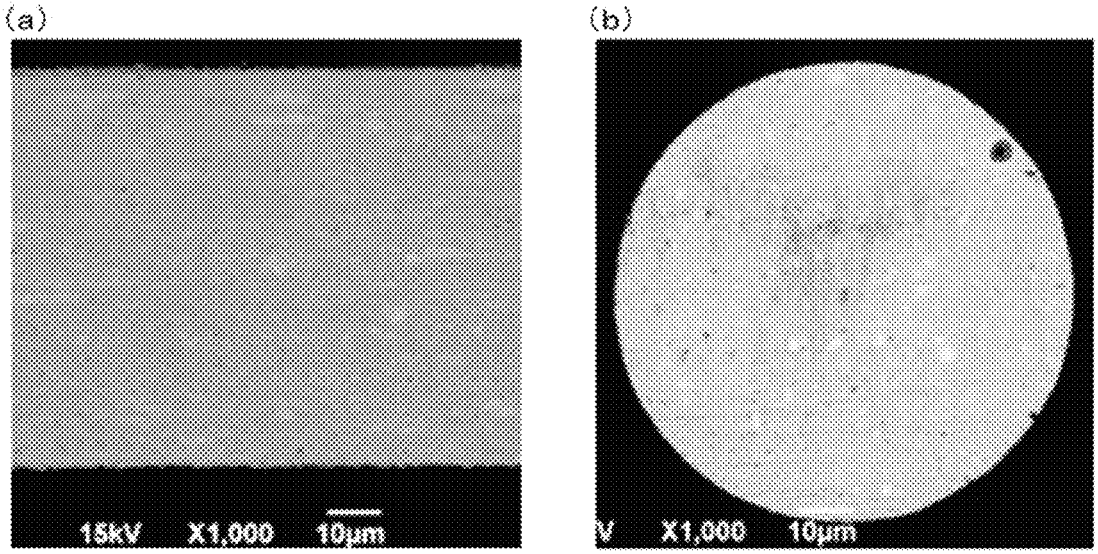
FIG. 2 shows SEM photographs of a vertical cross-section (a) and a horizontal cross-section (b) of Example 13.
Figure 3:
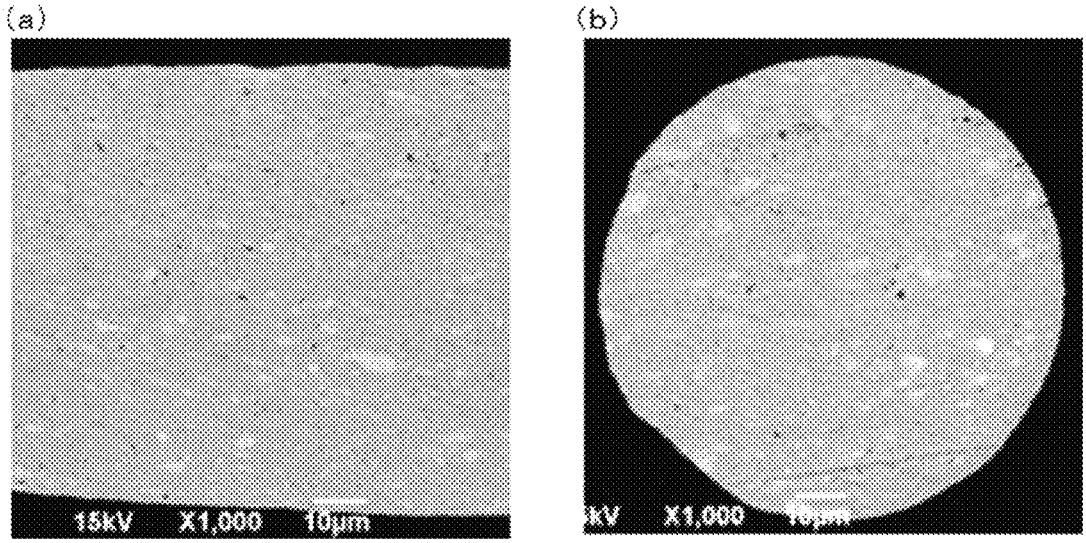
FIG. 3 shows SEM photographs of a vertical cross-section (a) and a horizontal cross-section (b) of Comparative example 5.

FIGS. 1, 2, and 3 show SEM photographs of Example 12, Example 13, and Comparative example 5, respectively, (a) shows a vertical cross-section and (b) shows a horizontal cross-section. In FIGS. 1 to 3, a portion which looks white is a composite phase and a portion which looks black is a copper parent phase. It was made clear that, in Examples 12 and 13, short fiber-shaped composite phases were dispersed in the copper parent phase, but in Comparative example 5, particulate composite phases were dispersed in the copper parent phase.

Figure 4:
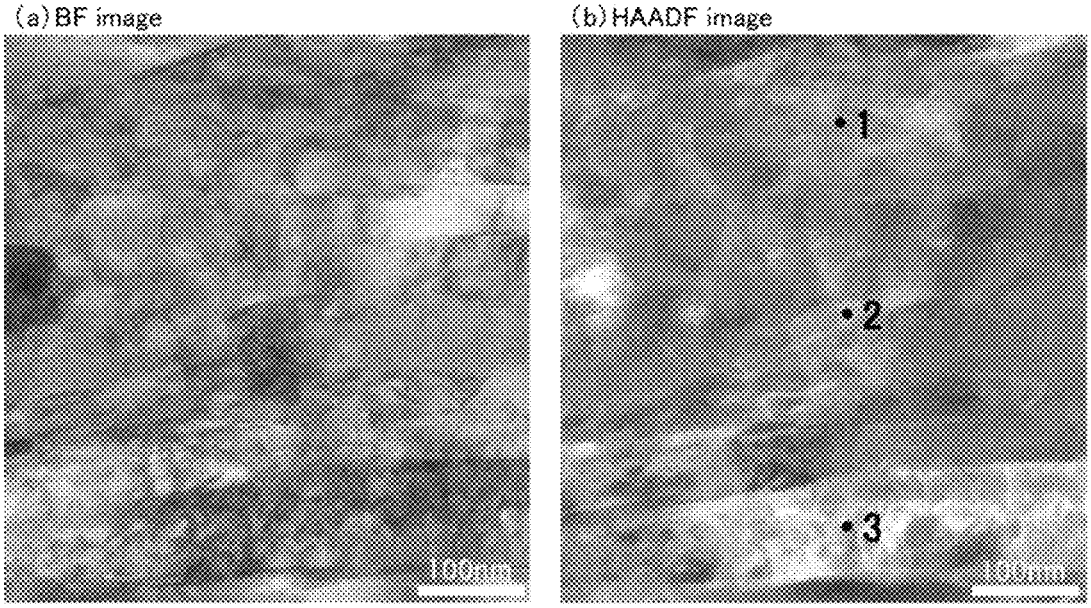
FIG. 4 shows STEM photographs of Example 12.
Figure 5:
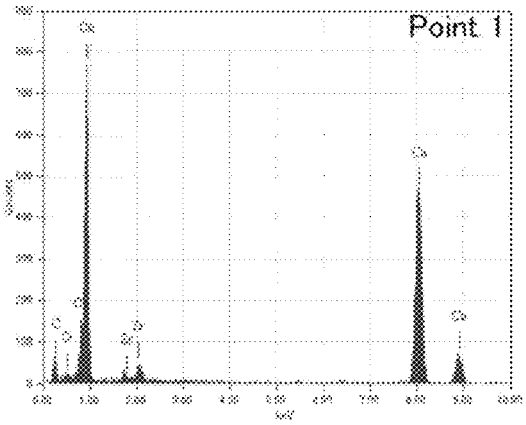
FIG. 5 shows EDX analysis results at each of Points (1 to 3) in FIG. 4.
Figure 5:
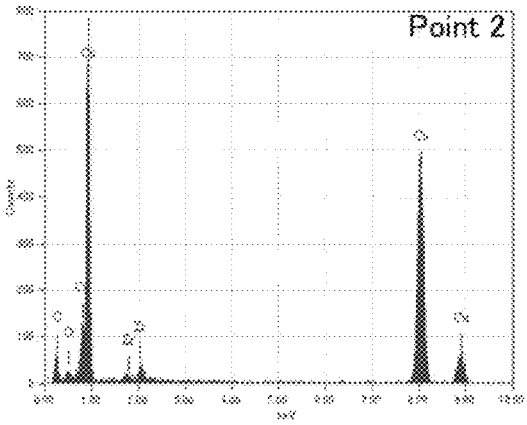
Figure 5:
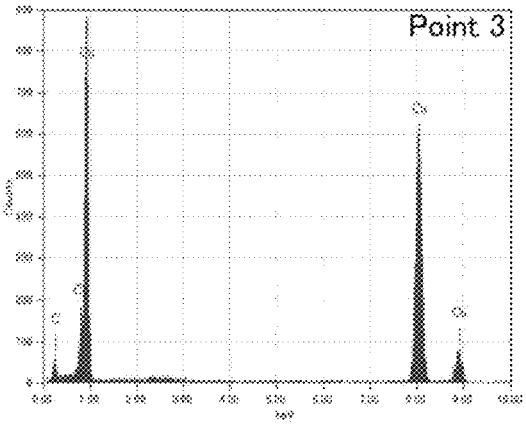
Figure 6:
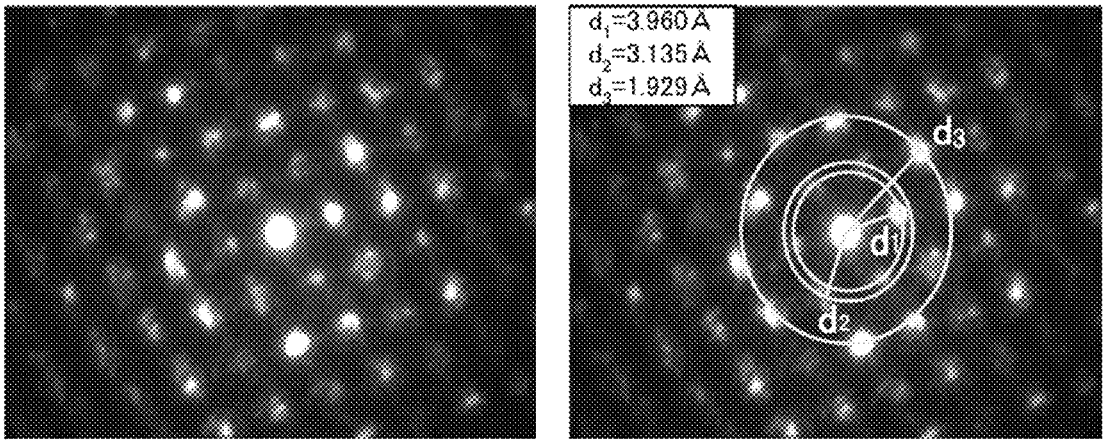
FIG. 6 shows NBD analysis results at Point 2 in FIG. 4.

FIG. 4 shows a bright field image (BF image) and a high-angle annular dark field image (HAADF image) of STEM of the composite phase in Example 12. FIG. 5 shows EDX analysis results at each of Points (1 to 3) in FIG. 4. It was made clear from the EDX analysis results that Points 1 and 2 were Cu—Zr compounds and Point 3 was Cu. FIG. 6 shows NBD analysis results at Point 2 (Cu—Zr compound) in FIG. 4. According to this, a lattice constant determined from each of typical three diffraction patterns other than the diffraction pattern of Cu was $d_1$=3.960 Å, $d_2$=3.135 Å, or $d_3$=1.929 Å. These lattice constants agreed (differences were within ±0.05 Å) with the lattice spacings of (200) plane, (022) plane, and (401) plane, respectively, of $Cu_8Zr_3$. Meanwhile, they did not agree with the lattice spacings of Cu5Zr and Cu9Zr2, which were considered to be contained in the composite phase. Consequently, it was made clear that the composite phase contained Cu and $Cu_8Zr_3$.

Figure 7:
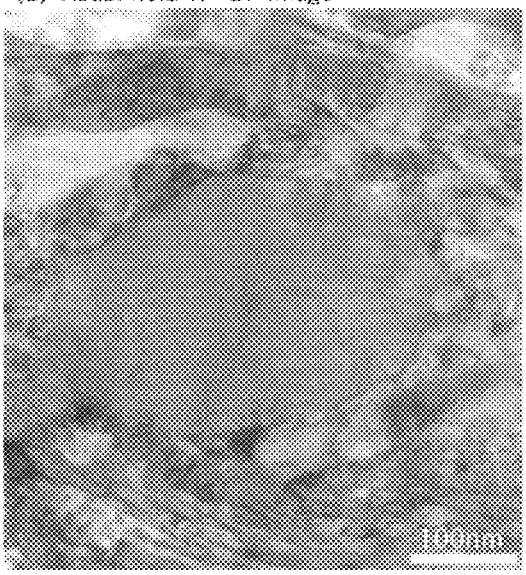
FIG. 7 shows STEM photographs of Example 13.
Figure 7:
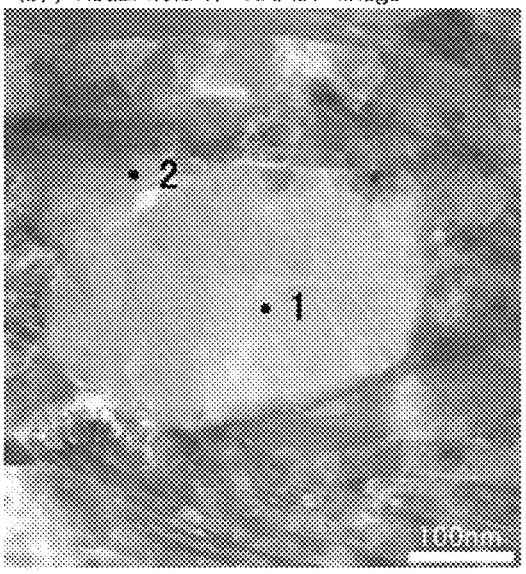
Figure 7:
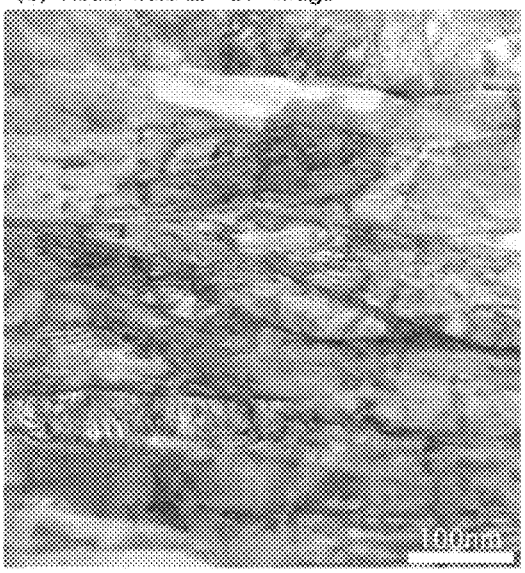
Figure 7:
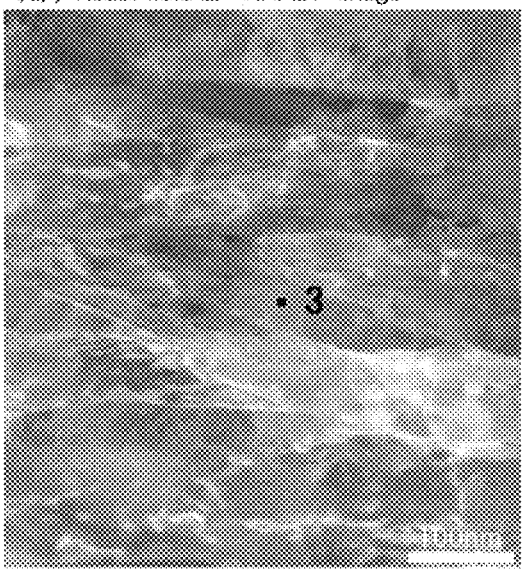
Figure 8:
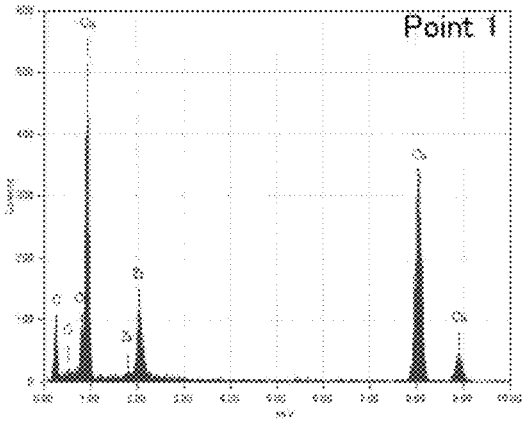
FIG. 8 shows EDX analysis results at each of Points (1 to 3) in FIG. 7.
Figure 8:
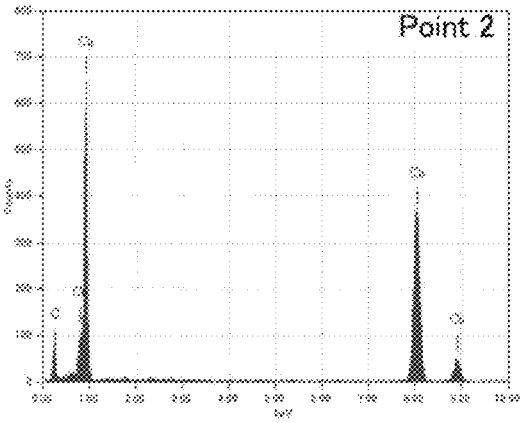
Figure 8:
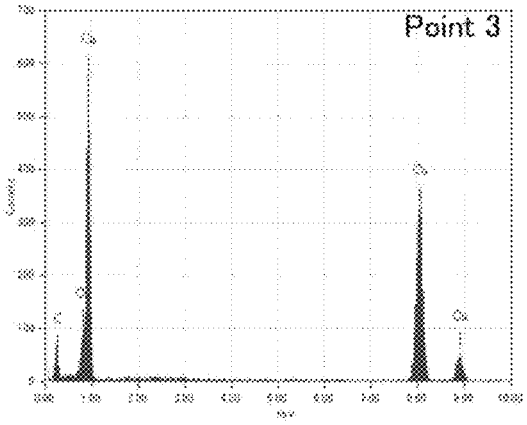
Figure 9:
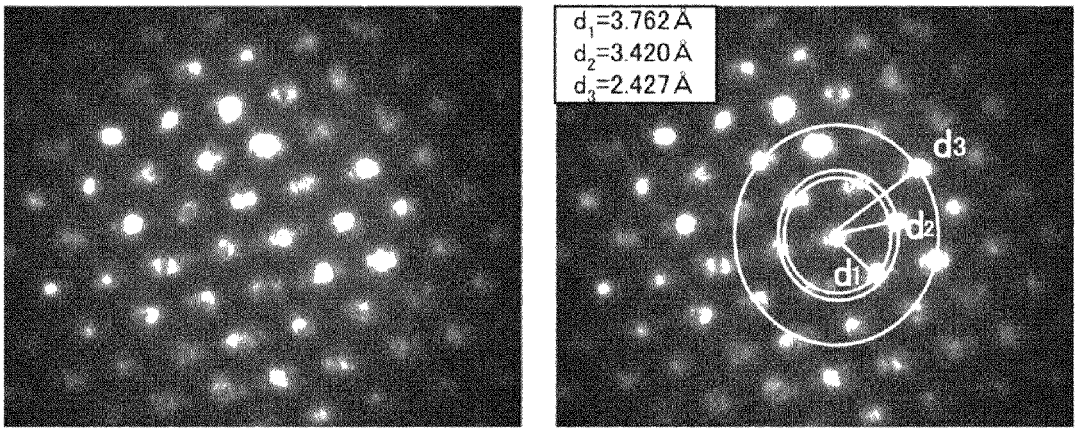
FIG. 9 shows NBD analysis results at Point 1 in FIG. 7.

FIG. 7 shows bright field images (BF images) and high-angle annular dark field images (HAADF images) of STEM of the composite phase in Example 13. A structure which seemed to be dislocation introduced by shear deformation was observed around a Cu—Zr compound in the vicinity of the center of FIGS. 7 (*a*) and (*b*). FIG. 8 shows EDX analysis results at each of Points (1 to 3) in FIG. 7. It was made clear from the EDX analysis results that Point 1 was a Cu—Zr compounds and Points 2 and 3 were Cu. FIG. 9 shows NBD analysis results at Point 1 (Cu—Zr compound) in FIG. 7. According to this, a lattice constant determined from each of typical three diffraction patterns other than the diffraction pattern of Cu was $d_1$=3.762 Å, $d_2$=3.420 Å, or $d_3$=2.427 Å. These lattice constants agreed (differences were within ±0.05 Å) with the lattice spacings of (021) plane, (121) plane, and (213) plane, respectively, of $Cu_8Zr_3$ (orthorhombic crystal). Meanwhile, they did not agree with the lattice spacings of $Cu_5Zr$ (cubic crystal) and $Cu_9Zr_2$ (tetragonal crystal), which were considered to be contained in the composite phase. Consequently, it was made clear that the composite phase contained Cu and $Cu_9Zr_3$.

Figure 10:
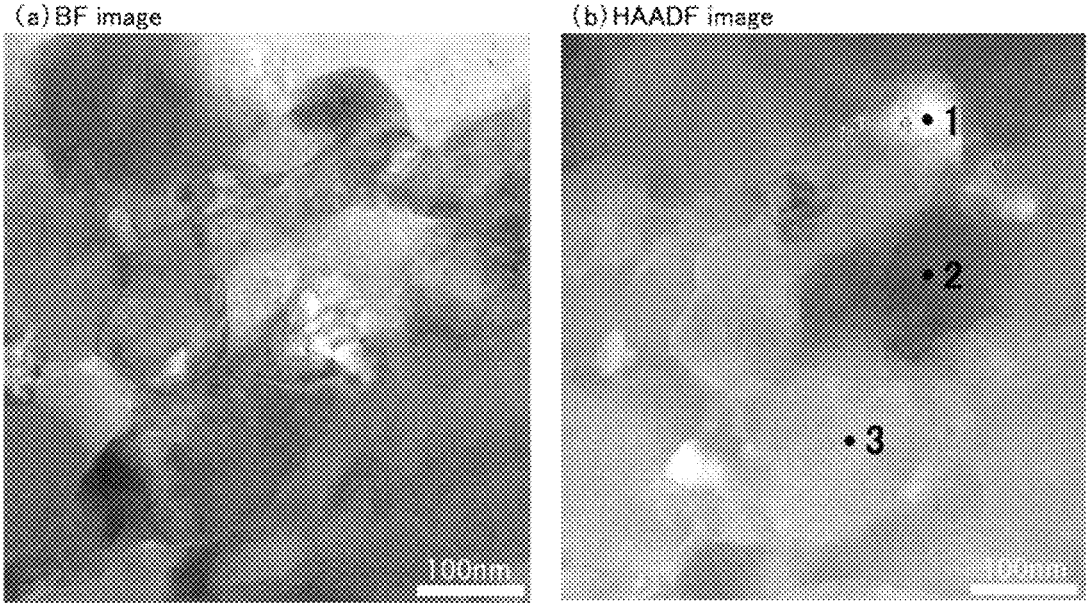
FIG. 10 shows STEM photographs of Comparative example 5.
Figure 11:
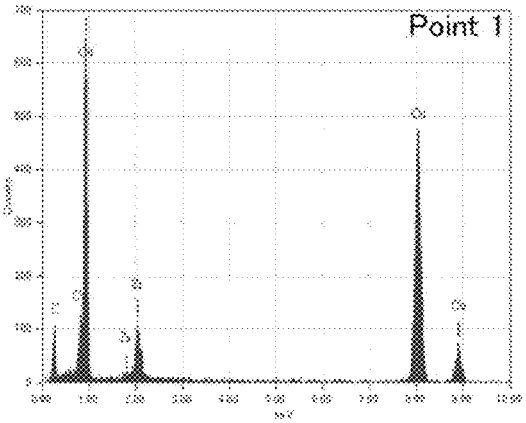
FIG. 11 shows EDX analysis results at each of Points (1 to 3) in FIG. 10.
Figure 11:
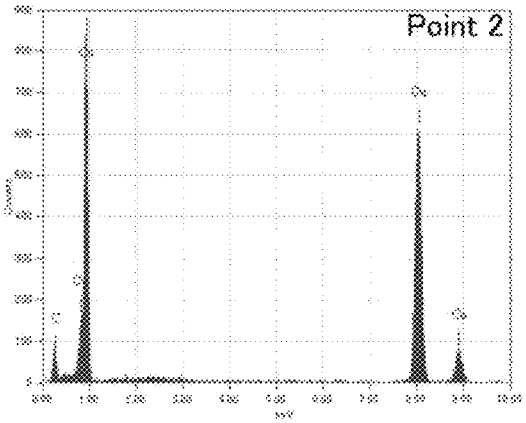
Figure 11:
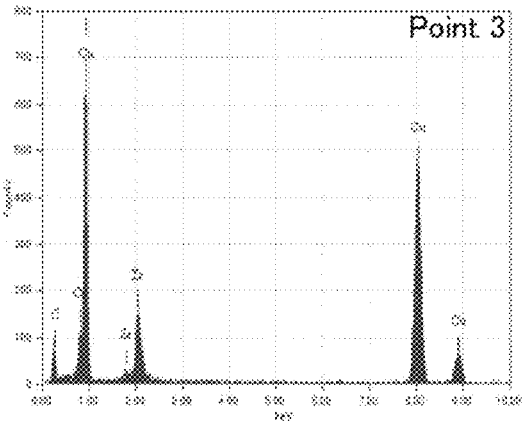
Figure 12:
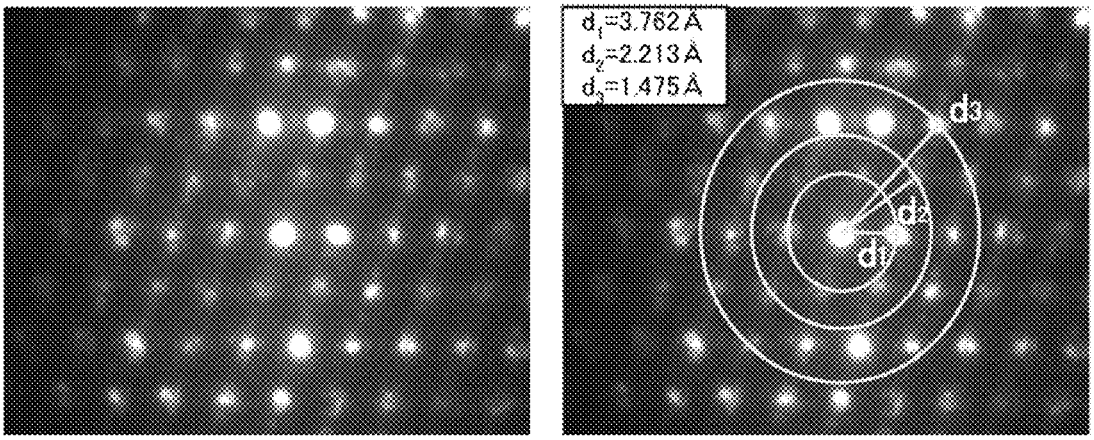
FIG. 12 shows NBD analysis results at Point 1 in FIG. 10.

FIG. 10 shows a bright field image (BF image) and a high-angle annular dark field image (HAADF image) of STEM of the composite phase in Comparative example 5. FIG. 11 shows EDX analysis results at each of Points (1 to 3) in FIG. 10. It was made clear from the EDX analysis results that Points 1 and 3 were Cu—Zr compounds and Point 2 was Cu. FIG. 12 shows NBD analysis results at Point 1 (Cu—Zr compound) in FIG. 11. According to this, a lattice constant determined from each of typical three diffraction patterns other than the diffraction pattern of Cu was $d_1$=3.762 Å, $d_2$=2.213 Å, or $d_3$=1.475 Å. These lattice constants agreed (differences were within ±0.05 Å) with the lattice spacings of (021) plane, (312) plane, and (512) plane, respectively, of $Cu_8Zr_3$. Meanwhile, they did not agree with the lattice spacings of $Cu_5Zr$ and $Cu_9Zr_2$, which were considered to be contained in the composite phase. Consequently, it was made clear that the composite phase contained Cu and $Cu_8Zr_3$. In Comparative example 5, the STEM image was not in the shape of a fiber but particulate and, therefore, it was estimated that the structure of Comparative example 5 was a recrystallized structure. In addition, it was made clear from the EDX analysis results that oxygen was not contained. As described above, it was estimated that recrystallized structure and presence of no oxygen had some effect on the tensile strength and the electrical conductivity.

Table 1 shows the proportions (atomic percent) of Zr in the raw materials, the wire drawing diameter, the degree of wire drawing η, the area ratio of composite phases, the aspect ratio of composite phase, the tensile strength, and the electrical conductivity of Examples 1 to 14 and Comparative examples 1 to 4. As is clear from Table 1, as for Comparative example 1 in which the proportion of Zr in the raw material composition was less than 0.20 atomic percent, the electrical conductivity was high, but the tensile strength was less than 700 MPa. Also, as for Comparative examples 2 and 3 in which the proportion of Zr in the raw material composition was more than 1.0 atomic percent and the composite phases were in the shape of fibers and were long-extended so as to form layers with the copper parent phase, the tensile strength was high, but the electrical conductivity was less than 70% IACS. Also, as for Comparative example 4 in which the proportion of Zr in the raw material composition was 0.2 atomic percent or more and 1.0 atomic percent or less and the composite phases were not in the shapes of short fibers but particulate, the electrical conductivity was high, but the tensile strength was less than 700 MPa. On the other hand, as for all the Examples 1 to 14, the tensile strengths were 700 MPa or more and the electrical conductivities were 70% IACS or more. As is clear from this, it was necessary that short fiber-shaped composite phases were dispersed in the copper parent phase and Zr was 0.2 atomic percent or more and 1.0 atomic percent or less in order to ensure the compatibility between the tensile strength of 700 MPa or more and the electrical conductivity of 70% IACS or more. Also, as is clear from Examples 1 to 14, the tensile strength was increased by increasing the proportion (atomic percent) of Zr and increase the degree of wire drawing η. Also, it was made clear that the electrical conductivity was able to be increased by decreasing the area ratio of the composite phases and reducing the value of the aspect ratio L/T of the composite phase. In this regard, it was made clear that the area ratio of the composite phases was hardly influenced by the degree of wire drawing η and was changed depending on the proportion of Zr. On the other hand, it was made clear that the aspect ratio of the composite phases was increased as the degree of wire drawing η increased.

TABLE 1

| | Cast workpiece | Wire drawing step | | Characteristics of wire rod | | | |
|---|---|---|---|---|---|---|---|
| | | Wire drawing | Degree of | Composite phase | | Tensile | Electrical |
| | Composition at % Zr | diameter mm | wire drawing η — | Area ratio % | Aspect ratio L/T — | strength MPa | conductivity % IACS |
| Example 1 | 0.20 | 0.04 | 11.2 | 0.50-1.00 | 9.2 | 703 | 88.9 |
| Example 2 | | 0.027 | 12.0 | 0.50-1.00 | 10.0 | 712 | 86.7 |
| Example 3 | 0.36 | 0.06 | 10.4 | 0.50-1.00 | 8.6 | 729 | 84.1 |
| Example 4 | 0.50 | 0.06 | 10.4 | 1.0-2.5 | 9.0 | 806 | 82.2 |
| Example 5 | | 0.10 | 9.4 | 1.0-2.5 | 8.4 | 754 | 83.4 |
| Example 6 | | 0.20 | 8.0 | 1.0-2.5 | 6.2 | 732 | 85.6 |
| Example 7 | | 0.50 | 6.2 | 1.0-2.5 | 3.2 | 711 | 86.4 |
| Example 8 | | 0.90 | 5.0 | 1.0-2.5 | 1.5 | 702 | 88.2 |
| Example 9 | 0.83 | 0.10 | 9.4 | 2.5-5.0 | 4.6 | 732 | 79.9 |
| Example 10 | 1.00 | 0.03 | 11.8 | 2.5-5.0 | 8.3 | 1011 | 70.2 |
| Example 11 | | 0.04 | 11.2 | 2.5-5.0 | 7.9 | 945 | 70.5 |
| Example 12 | | 0.06 | 10.4 | 2.6-5.0 | 7.7 | 998 | 70.4 |
| Example 13 | | 0.08 | 9.8 | 2.5-5.0 | 7.3 | 836 | 75.5 |
| Example 14 | | 0.20 | 8.0 | 2.5-5.0 | 6.6 | 732 | 80.3 |
| Comparative example 1 | 0.18 | 0.10 | 9.4 | 0.10-0.25 | 2.2 | 520 | 89.7 |
| Comparative example 2 | 1.08 | 0.20 | 8.0 | 5-10 | 17.9 | 746 | 67.9 |
| Comparative example 3 | 2.00 | 0.06 | 10.4 | 5-10 | 20.1 | 1189 | 68.9 |
| Comparative example 4 | 0.50 | 1.00 | 4.8 | 1.0-2.5 | 1.3 | 667 | 88.2 |

Table 2 shows the cross-sectional shape (long side, short side, aspect ratio, squareness), the tensile strength, and the electrical conductivity of Examples 15 to 17 in which the wire rod of Example 5 was subjected to flat wire rolling. As described above, it was made clear that the tensile strength and the electrical conductivity did not change significantly even when the flat wire rolling was performed. In this regard, the aspect ratio of the horizontal cross-section was allowed to become 5.0 or more by one rolling pass. Meanwhile, all of Examples 15 to 17 had rectangular cross-sections having squareness R/t of 0.1 or less. The reason for this was estimated that flat wire rolling was performed while the composite phases in the shapes of short fibers were in the state of being dispersed and, thereby, widening was suppressed.

TABLE 2

| | Rolling step | | | | Characteristics of wire rod | |
|---|---|---|---|---|---|---|
| | Long side μm | Short side μm | Aspect ratio (Long side/Short side) | Squareness; R/t Curvature/(Short side/2) <0.1 | Tensile strength MPa | Electrical conductivity % IACS |
| Example 15 | 225 | 40 | 5.6 | ○ | 759 | 82.2 |
| Example 16 | 370 | 25 | 14.8 | ○ | 764 | 83.9 |
| Example 17 | 620 | 12 | 51.7 | ○ | 745 | 84.3 |

Figure 13:
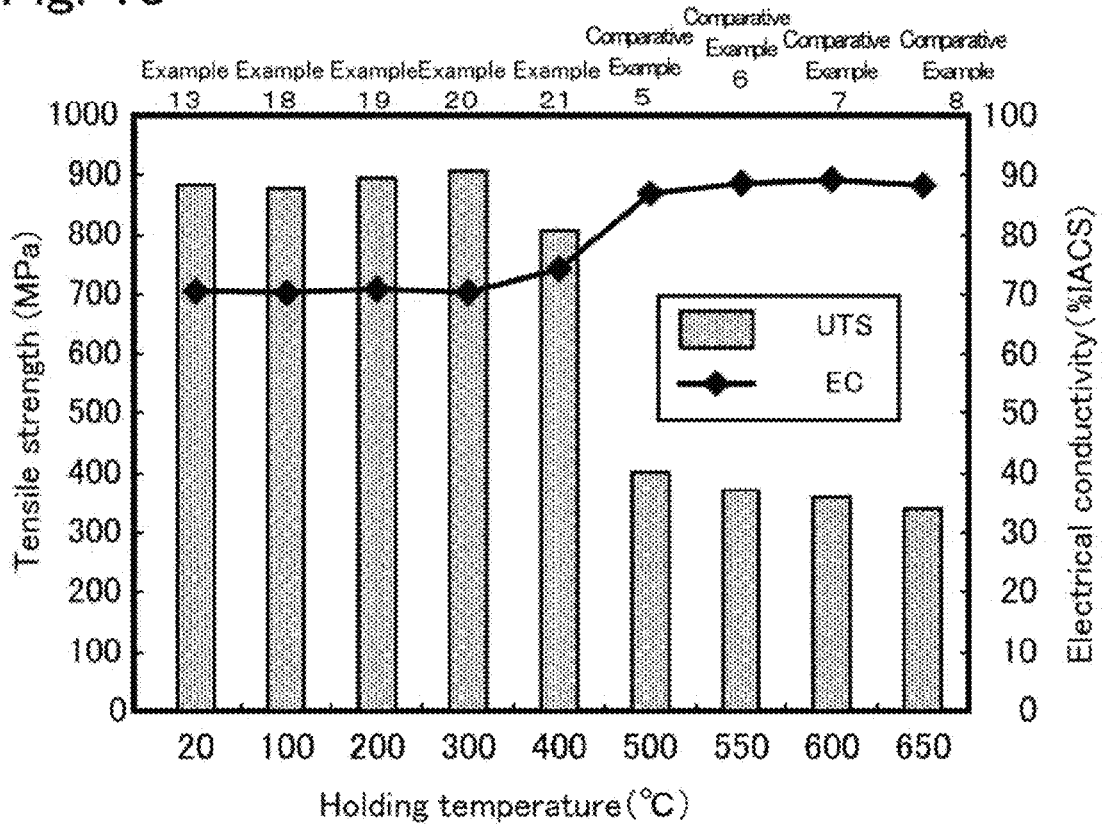
FIG. 13 is a graph showing the relationship of the holding temperature after wire drawing with the tensile strength and the electrical conductivity.

FIG. 13 is a graph showing the relationship of the holding temperature after wire drawing with the tensile strength and the electrical conductivity, that is, a graph in which the tensile strength and the electrical conductivity in Examples 13 and 18 to 21 and Comparative examples 5 to 8 are summarized. As is clear from this graph, in the case where holding was performed at a temperature lower than 500° C. (400° C. or lower), a tensile strength of 700 MPa or more and an electrical conductivity of 70% IACS or more were able to be maintained, although in the case where holding was performed at a temperature of 500° C. or higher, the tensile strength became less than 700 MPa. The reason for this was estimated that recrystallization occurred, as shown in FIG. 3 and FIG. 10 described above. As is clear from this, it was necessary that the wire drawing step and the treatment after the wire drawing step be performed at lower than 500° C. In the case of lower than 500° C., recrystallization does not occur easily and, therefore, the structure is allowed to remain in an unrecrystallized state, so that short fiber-shaped composite phases can be dispersed in the copper parent phase.

The present application claims priority from Japanese Patent Application No. 2011-214983 filed on Sep. 29, 2011, the entire contents of which are incorporated in the present specification by reference.

INDUSTRIAL APPLICABILITY

The present invention can be used in the field of wrought copper and copper alloy products.

What is claimed is:

1. A copper alloy wire rod comprising a copper parent phase and short fiber-shaped composite phases which are dispersed in the copper parent phase and which contain $Cu_8Zr_3$ and Cu, wherein the copper alloy contains Zr within a range of 0.2 atomic percent or more and 1.0 atomic percent or less, wherein the composite phase has a length L in the wire drawing direction and a length T in the direction orthogonal to the wire drawing direction, which satisfy $1.5 \leq L/T < 17.9$, wherein the copper alloy wire rod has an electrical conductivity of 70% IACS or more and a tensile strength of 700 MPa or more, and wherein the copper alloy is a binary alloy.

2. The copper alloy wire rod according to claim 1, wherein an area ratio of the composite phases is 0.5% or more and 5.0% or less.

3. The copper alloy wire rod according to claim 1, wherein the composite phase has a length L in the wire drawing direction and a length T in the direction orthogonal to the wire drawing direction, which satisfy $1.5 \leq L/T < 10.0$.

4. A method for manufacturing a copper alloy wire rod comprising:

a melting step of melting a raw material of a copper alloy having a Zr content within the range of 0.2 atomic percent or more and 1.0 atomic percent or less to obtain a molten metal;

a casting step of casting the molten metal so as to obtain an ingot; and a wire drawing step of subjecting the ingot to a cold wire drawing performed at lower than 500° C. and a treatment after the cold wire drawing performed at lower than 500° C.;

wherein the copper alloy wire rod comprises a copper parent phase and short fiber-shaped composite phases which are dispersed in the copper parent phase and which contain $Cu_8Zr_3$ and Cu, wherein the composite phase has a length L in the wire drawing direction and a length T in the direction orthogonal to the wire drawing direction, which satisfy $1.5 \leq L/T < 17.9$, wherein the copper alloy wire rod has an electrical conductivity of 70% IACS or more and a tensile strength of 700 MPa or more, and wherein the copper alloy is a binary alloy.

5. The method for manufacturing a copper alloy wire rod according to claim 4, wherein the wire drawing step is performed with a degree of wire drawing $\eta$ of 5.0 or more and 12.0 or less.

6. The method for manufacturing a copper alloy wire rod according to claim 4, wherein the treatment is a strain relief treatment that is performed at a temperature higher than the temperature of the cold wire drawing and lower than 500° C. for a period of 1 second or more and 60 seconds or less.

* * * * *